US005858214A

United States Patent [19]

Yap

[11] Patent Number: 5,858,214

[45] Date of Patent: Jan. 12, 1999

[54] PHOSPHATE BENEFICIATION PROCESS USING POLYMERS AS SLIME FLOCCULANTS

[75] Inventor: Seng N. Yap, Lakeland, Fla.

[73] Assignee: ARR-MAZ Products, L.P., Winter Haven, Fla.

[21] Appl. No.: 731,677

[22] Filed: Oct. 17, 1996

[51] Int. Cl.[6] ..... B03D 1/02

[52] U.S. Cl. ..... 209/166; 209/5

[58] Field of Search ..... 209/166, 5, 902

[56] References Cited

U.S. PATENT DOCUMENTS

| | | |
|---|---|---|
| 2,740,522 | 4/1956 | Aimare . |
| 3,020,231 | 2/1962 | Colwell et al. . |
| 3,314,537 | 4/1967 | Greene . |
| 3,418,237 | 12/1968 | Booth . |
| 3,515,666 | 6/1970 | Bacon . |
| 3,622,087 | 11/1971 | Oltmann . |
| 3,932,275 | 1/1976 | Mewes et al. . |
| 3,975,269 | 8/1976 | Ramirez . |
| 4,229,293 | 10/1980 | Caswell et al. . |
| 4,251,363 | 2/1981 | Chamberlain et al. . |
| 4,265,770 | 5/1981 | Thomas . |
| 4,330,398 | 5/1982 | Afford . |
| 4,478,736 | 10/1984 | Raba, Jr. et al. . |
| 4,498,993 | 2/1985 | Raba, Jr. et al. . |
| 4,687,571 | 8/1987 | Kari . |
| 4,690,752 | 9/1987 | Shaw . |
| 5,104,551 | 4/1992 | Davis et al. . |

FOREIGN PATENT DOCUMENTS

| | | |
|---|---|---|
| 215787 | 1/1957 | Australia . |
| 607409 | 10/1960 | Canada . |
| 0455077A2 | of 0000 | European Pat. Off. . |
| 53-99656 | 8/1978 | Japan . |
| 38498 | 1/1991 | Japan . |
| 3161099 | 7/1991 | Japan . |
| 1411297 | 2/1988 | U.S.S.R. . |

OTHER PUBLICATIONS

El–Shall et al., Dewatering of Phosphate Clays—Role of Polymer Flocculation pp. 263–278.

*Primary Examiner*—Thomas M. Lithgow

*Attorney, Agent, or Firm*—Joseph C. Mason, Jr.; Dennis G. LaPointe

[57] ABSTRACT

The present invention relates a process for simultaneously preventing formation of slime stabilized foam and decreasing reagent consumption in a phosphate beneficiation flowsheet comprising adding an effective amount of a polymer to a rougher feed slurry and/or a cationic feed slurry wherein the polymer flocculates slime, adding an effective amount of a collector and removing the flocculated slime by flotation.

28 Claims, 1 Drawing Sheet

PHOSPHATE BENEFICIATION PROCESS USING POLYMERS AS SLIME FLOCCULANTS

FIELD OF THE INVENTION

This invention relates, generally, to the use of polymers in phosphate ore beneficiation. Specifically, the present invention relates to the use of polymers as slime flocculants during the beneficiation process.

BACKGROUND OF THE INVENTION

Phosphate rock is a major phosphate source for agricultural fertilizers. Before chemical processing to produce fertilizers, the phosphate ore is mined and beneficiated to upgrade phosphate content. Phosphate content is generally measured in terms of $P_2O_5$. During beneficiation the phosphate content is upgraded from about 4 to 10 percent $P_2O_5$ to about 31 to 33 percent $P_2O_5$. Clays and silica are the major impurities found in Florida phosphate ore. In general, Florida phosphate ore deposits, i.e., matrix, contain about a third recoverable phosphate, a third silica, i.e., sand, and a third clay, i.e., −150 mesh size (Tyler) fraction materials.

In a typical Florida phosphate mining operation, the matrix is excavated by a dragline, slurried, and pumped to the beneficiation plant for processing. A typical beneficiation plant contains three major processes, sizing, desliming, and flotation. Products in the beneficiation plant are classified according to the size fractions measured in terms of mesh size (Tyler).

As the matrix is delivered to the beneficiation plant, the sizing process produces a product called pebble. Pebble is the first final product of the beneficiation process and contains phosphate particles greater than 14 mesh size. Materials containing particles smaller than 14 mesh size are reported to a desliming process for clay separation. Clay is a waste by-product of the beneficiation process and contains particles smaller than 150 mesh size. During the desliming process, most of the clay is removed from the matrix and pumped to storage areas called clay settling ponds. As the clay is settled in the clay settling ponds, process water is reclaimed and routed for reuse in the mining and beneficiation processes.

The majority of clay is rejected as the phosphate pebble is sized. The materials remaining after sizing, called feed, contain particles ranging from −14 mesh to +150 mesh sizes. This feed contains phosphate particles (4 to 10 percent of $P_2O_5$), 70 to 80 percent silica, and a small residue of clay. In order to remove the silica from the phosphate particles, the feed is fed to a flotation process which normally contains two flotation circuits. The first flotation circuit is called a rougher flotation circuit. The second flotation circuit is called a cationic or cleaner flotation circuit.

In the rougher flotation circuit, the silica content is reduced from 70–80 percent to 20–30 percent. The feed slurry is preconditioned with a fatty acid soap. The fatty acid soap is preferentially adsorbed by the phosphate particles, causing the phosphate particles to become hydrophobic. When the hydrophobic phosphate particles are introduced into the flotation device the phosphate particles attach to the air bubbles and float. Most of the silica particles remain in the water and sink. The floated phosphate ore, i.e., rougher concentrate, is then de-oiled by scrubbing with dilute sulfuric acid ($H_2SO_4$) at a pH of 2.5–4.0, followed by rinsing with water.

The rougher concentrate slurry is subsequently fed into the cationic or cleaner flotation circuit for a second froth flotation process, in which the silica is reduced further to 3–10 percent. In the cationic or cleaner flotation circuit the rougher concentrate is treated with reagents which act as silica collectors. Oftentimes these cationic collectors are long-chain amines, in which case the cationic or cleaner flotation circuit is referred to as an amine flotation circuit. Accordingly, all flotation circuits using amines as collectors are referred to as amine flotation circuits. As such, the feed which reports to an amine flotation circuit is called an amine feed. In the cationic or cleaner flotation circuit, the collector is preferentially adsorbed by the silica causing the surface of the silica particles to become hydrophobic. The hydrophobic silica particles attach to the air bubbles and float. As the silica is removed, the remaining materials in the cationic or cleaner circuit are called concentrate. This concentrate is the second final product of the beneficiation plant.

In some beneficiation plants, materials containing size fractions smaller than 14 mesh and greater than 28 mesh are mechanically separated (i.e., screen or hydro-separation) from the feed. These materials are called an intermediate product. For some uses, the intermediate product is the final product of a beneficiation plant and does not require any flotation. Following this separation, the remainder of the feed (−28 mesh to +150 mesh) reports to the flotation process. Flotation feed size fractions generally vary from plant to plant depending on the overall plant flowsheet.

In beneficiation processes, large amounts of process water are used and subsequently recycled for reuse in all phases of processing such as sizing, desliming, washing, rinsing, and flotation. Fresh water from aquifers is pumped through deep wells and used in conjunction with the recycled process water. This recycled water contains both clay and phosphate slimes, with the majority of the slime being clay slime.

Recently, the conservation of fresh water in aquifers has been one of the most challenging issues facing the Florida phosphate industry. As part of the fresh water conservation effort, the deep well water which was previously used in beneficiation processes has been replaced by recycled process water. In order to hasten the settling process of clay slime and to facilitate water reclamation, a great deal of research has been done on the use of polymers to flocculate clay slime in settling ponds, for example, U.S. Pat. No. 3,020,231 to Colwell et al., EP 0 455 077 A2 to von Bonin et al., JP 3-8498 (1991) to Nippon Shokubai Kagaku, U.S. Pat. No. 4,265,770 to Thomas, U.S. Pat. No. 4,241,363 to Chamberlain et al. and U.S. Pat. No. 5,104,551 to Davis et al. Settling pond clay slime flocculation methods have also used polymers in combination with other materials, for example, U.S. Pat. Nos. 4,498,993 and 4,478,736 to Raba, Jr. et al., JP 53-99656 (1978) to Agency of Ind. Sci. Tech., JP 3-161099 to Kyoritsu Yuki Kogyo and U.S. Pat. No. 3,932,275 to Mewes et al. However, because of the economics, flocculants are rarely used in the field.

Therefore, the recycled process water from these reclamation and settling processes can still contain significant amounts of (−150 mesh) slime particles. The increasing use of slime contaminated process water in beneficiation processes imposes significant processing problems, particularly in flotation processes.

Two major problems are commonly observed. One of the problems is a marked increase in reagent, also known as collectors, consumption. Collectors useful in phosphate beneficiation include anionic collectors and cationic or amine collectors. The presence of slime causes the depletion of the collectors for the phosphate and silica flotation because the collectors are preferentially adsorbed by the fine slime particles. In order to float the phosphate or silica properly, collector dosages have to be markedly increased, especially the amine/cationic collectors. If the necessary increase in anionic collectors, for example, fatty acid/fatty acid soap and fuel oil is not provided, phosphate recovery in the rougher flotation circuit is low. If the necessary increase in cationic collectors, for example, amine is not provided, the final concentrate grade of the cationic or cleaner flotation circuit is poor. The second problem encountered, when slime is present during the beneficiation process, is the formation of a stable foam. This stable foam overflows the flotation cells and launders creating operational problems.

In view of the prior art considered as a whole at the time the present invention was made, it was not obvious to those of ordinary skill in the pertinent art how these problems could be overcome.

SUMMARY OF THE INVENTION

The long-standing but heretofore unfulfilled need for an improved phosphate beneficiation process which simultaneously prevents formation of stable foam and decreases reagent consumption is now met by a beneficiation process comprising adding an effective amount of a polymer to a rougher feed slurry wherein the polymer flocculates slime, adding an effective amount of a collector and removing the flocculated slime by flotation. This deslimed rougher feed can then be beneficiated using current flotation processes which consist of a rougher (fatty acid soap) flotation circuit and a cationic or cleaner (amine) flotation circuit. Alternatively, this deslimed rougher feed can be beneficiated using a fatty acid soap flotation circuit without a cationic flotation circuit. Further, this deslimed rougher feed can be beneficiated using a cationic flotation circuit without a fatty acid soap flotation circuit.

Another embodiment of the improved phosphate beneficiation process of the present invention comprises adding an effective amount of a polymer to a cationic or cleaner (amine) feed slurry wherein the polymer flocculates slime, adding an effective amount of a collector to float the flocculated slime and the silica.

Polymers useful in the present invention include natural polymers, semisynthetic polymers, synthetic polymers, and mixtures thereof. Polymer is added to the beneficiation process of the present invention in a water dispersion of from 0.001 to 2.5 percent by weight. In a preferred embodiment of the present invention, polymer is added in a water dispersion of from 0.05 to 1.0 percent by weight.

The invention accordingly comprises the features that will be exemplified in the description hereafter set forth, and the scope of the invention will be indicated in the claims.

BRIEF DESCRIPTION OF THE DRAWINGS

For a fuller understanding of the nature and objects of the invention, reference should be made to the following detailed description taken in connection with the accompanying drawing, in which.

DETAILED DESCRIPTION OF THE INVENTION

Figure 1:
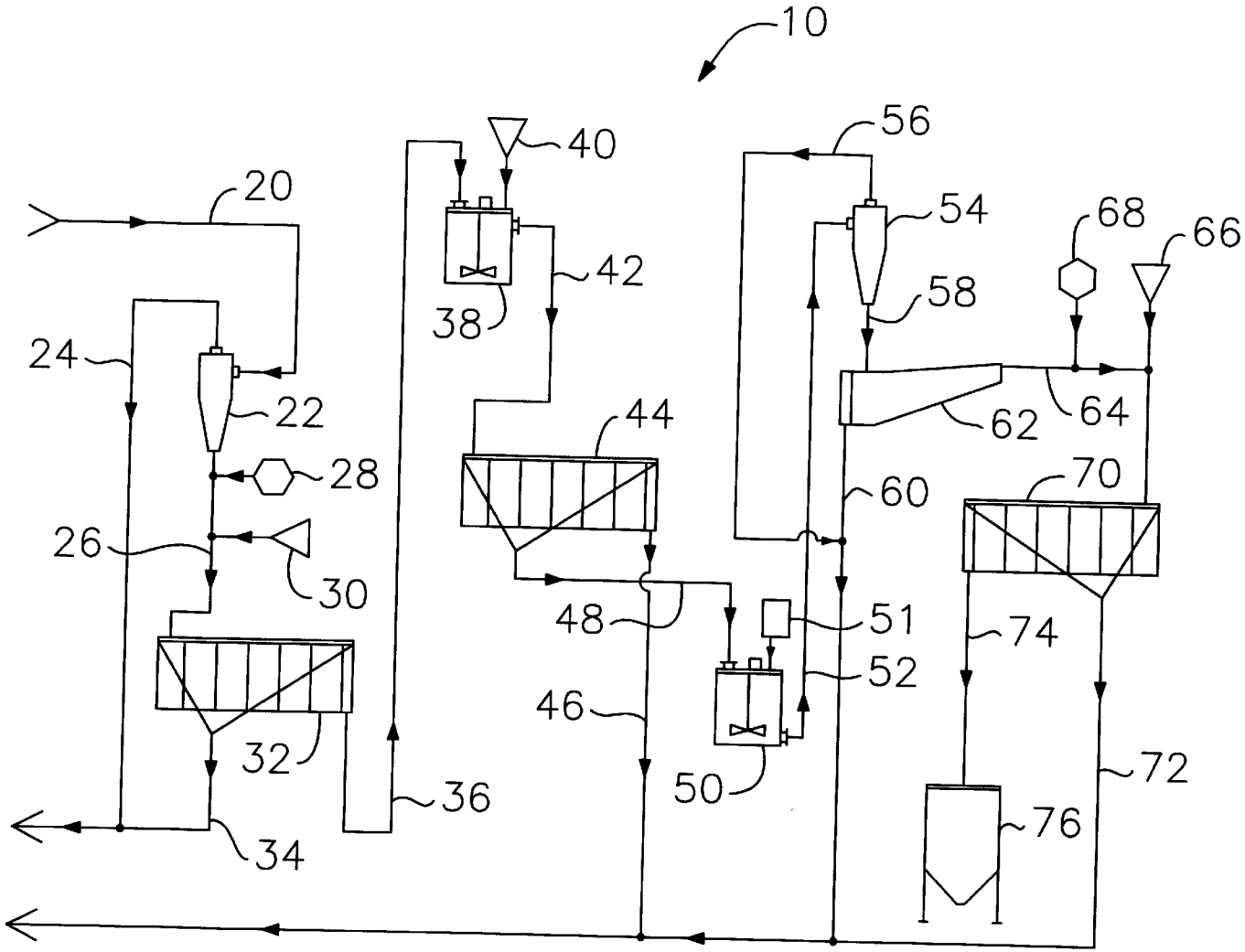
FIG. 1 is a schematic process flowsheet wherein the addition of polymer during the beneficiation process is shown.

Referring now to FIG. 1, a phosphate flotation circuit of the present invention is denoted as a whole by reference numeral 10. As shown in FIG. 1, circles represent and identify equipment and material flow, triangles represent and identify collector addition points, squares represent and identify acid addition points and hexagons represent and identify polymer addition points in the beneficiation flowsheet.

As shown in FIG. 1, line 20, the flotation feed, carries a phosphate rock slurry, −28 mesh to +150 mesh from a desliming circuit (not shown) to a flotation process. It is understood that reference numerals in the present description may represent and identify both equipment and material flow. For example, 20 represents a line (equipment) for transporting the flotation feed slurry, 20, (material flow) during the beneficiation process. It is understood that for purposes of the present invention a line may be any type of conduit or pipe device. In addition, it is understood by those skilled in the art that water may be added into equipment and/or lines. Further, it is known in the art that a beneficiation process may be an open process in which reagents, water and materials can be added at numerous points.

During the desliming circuit (not shown), phosphate rock slurry from the mine excavation site is sized in a sizing device. Numerous sizing devices, known in the art, are useful in the present invention. Further, one or more sizing devices may be used in the beneficiation process. The sizing device separates the −150 mesh (Tyler) size fraction from the −28 to +150 mesh size fraction. The −150 mesh size fraction which contains slime is discarded and transported to settling ponds (not shown) for water reclamation. The −28 to +150 mesh size fraction, the flotation feed, contains phosphate ore.

The flotation feed slurry, 20, flows into a dewatering cyclone 22, where flotation feed slurry, 20 is dewatered. The dewatering cyclone overflow, 24, which contains −150 mesh size particles flows via line 24 to slime settling ponds (not shown). The dewatered flotation feed, also called a rougher flotation feed, 26, from dewatering cyclone 22 flows into flotation device 32, via line 26. While en route to flotation device 32, rougher flotation feed, 26, is reacted with a polymer or polymers, 28, and a collector or collectors, 30. Preferably, polymer 28 is added prior to the addition of collector 30. Polymer, 28, is added to the rougher flotation feed, 26, in the form of an aqueous dispersion. The aqueous dispersion contains from 0.001 to 2.5 percent by weight polymer, while in a preferred embodiment the aqueous dispersion contains from 0.05 to 1.0 percent by weight polymer.

Polymers useful in the present invention include synthetic polymers such as non-ionic polyacrylamide, polyethylene oxide, anionic hydrolyzed polyacrylamide, acrylamide/acrylate copolymer, cationic arylamide/diallyldimethylammonium chloride copolymer, acrylamide/amine copolymer, polyethylene amines, quaternized polyamines, polydiallyldimethylammonium chloride, polyethylene imine, polyalkalene polyamine; semisynthetic polymers such as carboxymethylcellulose, methylcellulose, hydroxyethylcellulose, guar gum derivatives, xanthan gum; and natural polymers such as gum arabic, locust bean gum, guar gum, and mixtures thereof.

Various collectors known in the art can be used in the present invention. For example, U.S. Pat. Nos. 3,353,672, 3,361,257, 4,138,350, 4,139,481 and 4,139,482, which are incorporated herein by reference, disclose agents which are useful in the present invention as collectors. Specifically, cationic collectors useful in the present invention include long chain amines, amine salts including amine acetates and long chain quaternary ammonium salts. Generally, the long chain amines useful in the present invention are derived from tall oil fatty acids, tallow fatty acids and long chain alcohols. More specifically, the long chain amines are preferably fatty amido amines, tallow amines, ether amines or their acetates. Further, the amines useful in the present invention may be polyfunctional.

Following the addition of collector, 30, rougher flotation feed 26, reports to flotation device 32. Numerous mechanical flotation devices are known in the art, for example, Denver flotation devices, Wemco flotation devices and Autokumpu flotation devices. Alternatively, column flotation devices are also useful in the present invention. For example, packed columns such as those manufactured by GL & V Process Equipment Group, Inc., Ontario, Canada are useful in the present invention. Similarly, it is known by those skilled in the art that skin flotation or belt flotation devices in which water jets or water sprays are used as an air source are useful in the present invention. Alternatively, flotation devices which employ techniques such as the free fall of rock slurry into a container of upward velocity water and sparged cyclones such as those disclosed in U.S. Pat. Nos. 4,279,743 and 4,744,890, which are incorporated herein by reference, are also useful in the present invention. Separate air generators may also be used in the flotation processes of the present invention.

Polymer, 28, causes slime to aggregate, coagulate or flocculate, which is collectively referred to hereinafter as flocculate. Collector, 30, causes fine silica particles and the flocculated slime to become hydrophobic. Both the hydrophobic fine silica particles and the hydrophobic flocculated slime float in flotation device 32. The amount of collector can be controlled by those skilled in the art to float most of the slime and to float a desired amount of silica. Further, flotation device 32 may consist of more than one flotation unit. The rejected slime and fine silica adherent particles are removed as part of the froth, 34, from the top of flotation device 32. These rejected particles, 34, are transported by line 34, to sand disposal/settling ponds (not shown).

The deslimed rougher feed or underflow of flotation device 32, which contains the phosphate fraction, 36, flows into conditioning tank 38. Conditioning tank 38 is equipped with an agitator or mixing paddles for mixing the phosphate rock slurry during the conditioning process. While in conditioning tank 38 the phosphate rock slurry is treated with collector 40. Collector 40, consists of a pH modifier such as caustic soda, soda ash or ammonia, and fatty acids and fuel oil. In addition, petroleum sulfonates and other surfactants known in the art may also be added. During conditioning the fatty acid soap is chemisorbed onto the surface of the phosphate particles causing them to become hydrophobic. When the slurry or reagentized flotation feed, 42, containing the hydrophobic phosphate particles is introduced into flotation device 44, the phosphate particles attach to air bubbles and float. The phosphate particles are removed from the top of flotation device 44 as part of the froth, 48. The majority of the silica/sand particles remain in the water and sink in flotation device 44. The silica/sand particles are transported from flotation device 44 through line 46 to sand disposal areas (not shown). The upgraded phosphate ore derived from this process is called a rougher concentrate 48.

The rougher concentrate, 48, contains 15 to 30 percent silica. The silica content is further reduced to 3 to 10 percent in a cationic or cleaner flotation circuit. Prior to the cationic or cleaner flotation circuit the surface of the phosphate particles in the rougher concentrate must be freed of collector. This process is sometimes referred to as de-oiling.

The rougher concentrate, 48, flows into de-oiling tank 50. The rougher concentrate is de-oiled by scrubbing with dilute sulfuric acid ($H_2SO_4$). $H_2SO_4$, 51, is added to de-oiling tank 50. The pH in the de-oiling slurry is preferably between 2.5 and 4.0. After the acid scrub, the de-oiled rougher concentrate, 52, flows into dewatering cyclone 54. The acid water cyclone overflow, 56, flows into line 60 for transport to sand disposal/settling ponds (not shown). Dewatering cyclone 54, underflow, 58, flows into rinse device, 62. Rinse devices useful in the present invention include screw classifiers, which are known in the art. Rinse water, 60, from rinse device 62, is rejected and transported to sand disposal areas (not shown). The rinsed cationic or cleaner feed slurry, 64, and the process water being used to dilute the feed are treated with a polymer or polymers, 68, and a cationic collector or collectors, 66, while en route to cationic or cleaner flotation device 70. Preferably, polymer 68 is added before cationic collector 66. Polymer, 68, is added to the feed slurry, 64, in the form of an aqueous dispersion of from 0.001 to 2.5 percent by weight polymer, preferably the aqueous dispersion contains from 0.05 to 1.0 percent by weight polymer. Polymer, 68, causes slime to flocculate.

The cationic collector, 66, is added to the cationic or cleaner feed slurry, 64, or to a distribution box (not shown), in the form of a 3–10 percent by weight aqueous dispersion. After addition of cationic collector 66, the entire mixture is transported to flotation device 70. The cationic collector, 66, which is positively charged is preferentially adsorbed by slime and negatively charged silica, causing the surface of the flocculated slime and the silica particles to become hydrophobic and to attach to air bubbles and float in flotation device 70. These adherent particles are removed from the top of flotation device 70 as part of the froth 72 and are transported to sand disposal areas (not shown). The phosphate particles remain in the water and sink. The concentrated phosphate 74, called a final concentrate, is transported from flotation device 70 to storage bin 76. The final concentrate is allowed to dry in storage bin 76.

The present invention, as more fully described in the Examples below, has many benefits over prior art beneficiation flowsheets. The major benefit of the present invention is the ability to float the flocculated slime. Specifically, slime can be eliminated from the flotation feed of the rougher flotation circuit prior to a conditioning stage. The flocculated slime must be removed prior to the conditioning stage, otherwise, the mechanical forces in the conditioner will cause the flocculated slime to redisperse, and the benefit of adding polymer, 28, is lost.

In addition, since the slime and the fine silica are removed prior to conditioning, the rougher feed grade, 36 is upgraded, and the tonnage of the rougher feed is therefore reduced. This is very beneficial for low grade ore; if half of the silica is rejected, the tonnage of the feed can be reduced by almost half as shown in Example 1, Table 1. This can double plant capacity and it allows longer retention time for the ore in the conditioner and in the flotation device which ultimately improves phosphate recovery. Furthermore, the rejection of fine silica prior to the rougher flotation circuit can improve the rougher concentrate grades. When the rougher concentrate grade is acceptable as the final phosphate concentrate product, the cationic flotation circuit can be eliminated. For example, phosphate concentrate grades of 5–10% acid insoluble (acid insoluble contains mostly silica) can be obtained simply by refloating the rougher concentrate in water as described in Example 1, Tables 2 and 3.

In current practice, the rougher concentrate is transported to the de-oiling tank prior to entering the cationic or cleaner flotation circuit. If the phosphate particles are not properly de-oiled, the phosphate particles will be floated in the amine flotation circuit and discarded as waste together with the silica. Oftentimes, in the present invention, an amine flotation circuit is not needed, therefore the de-oiling process becomes less critical. This benefit of the present invention is particularly important when the carbonate content of the rock is high, because it is often difficult to maintain the acidic conditions necessary for complete de-oiling of the surface of the phosphate particles. High carbonate content requires a large excess of sulfuric acid because the acid is consumed by the carbonates. The increased amount of sulfuric acid used in the de-oiling process increases the loss of $P_2O_5$ due to leaching of phosphate rock. This invention, which can obtain an acceptable phosphate grade without an amine flotation circuit, circumvents these problems.

In view of the above benefits, attempts have been made by various investigators to prefloat (reject) fine silica using amine collectors prior to the rougher flotation circuit. However, when slime is present, collector consumption increases to the extent that this approach is not economically feasible. The elimination of slime in the rougher flotation feed opens up the possibility of the development of new beneficiation flow sheets. One possible approach is to eliminate the use of fatty acid soap. Laboratory testing has shown successful results in beneficiating a well deslimed phosphate rougher flotation feed using amine and quaternary ammonium salts as collectors. Another example of the benefit of this invention is the feasibility of beneficiating phosphate ore of −150 to +200 mesh size fraction, by known or new flotation processes. This size is currently rejected because of high reagent consumption. Furthermore, the present invention can be practiced without high capital investment.

EXAMPLES

The following examples are presented to illustrate the invention, which is not intended to be in any way limited thereto, since numerous modifications and variations therein will be apparent to one skilled in the art. Actual experimental data was obtained as follows:

Example 1

The results of using polymer and amine collector to float slime and fine silica from the rougher feed are shown is Table 1. Specifically, in the present example, polymer 28, was added to rougher flotation feed slurry 26. The treated flotation feed 26 then reported to flotation device 32. Amine collector 30 was added to a water stream entering flotation device 32. The results and quantities of reagents used are shown in Table 1.

TABLE 1

| FEED SOURCE | FEED ($P_2O_5$ %) | POLYMER (g/kg rock) | AMINE (g/kg rock) | CONC. (wt %) | CONC. ($P_2O_5$ %) | SLIME TAILS (wt %) | SAND TAILS (wt %) | SAND TAILS ($P_2O_5$ %) | $P_2O_5$ RECOVERED % |
|---|---|---|---|---|---|---|---|---|---|
| #1 | 5.5 | 0.03 | 0.2 | 52 | 10.1 | 3 | 45 | 0.7 | 96 |
| #2 | 9.4 | 0.03 | 0.2 | 46 | 19 | 1–2 | 53 | 1.2 | 93 |

As shown in Table 1, the process of the present invention upgrades the $P_2O_5$ content from 5.5% to 10.1% of feed #1, and from 9.4% to 19% of feed #2. Most of the slime and finer silica, which constitutes about half of the feed weight, is rejected.

This up-graded rougher feed, 36, which is the concentrate in Table 1, was conditioned in conditioner 38, with collector 40, soda ash, fatty acid and fuel oil. Following conditioning the reagentized flotation feed 42 reported to flotation device 44, resulting in the production of rougher concentrate 48. The results and quantities of reagents used are shown in Table 2.

TABLE 2

| FEED SOURCE | FEED ($P_2O_5$ %) | FATTY ACID (g/kg rock) | FUEL OIL (g/kg rock) | CONC. (wt %) | CONC. INSOL (%) | CONC. ($P_2O_5$ %) | TAILS (wt %) | TAILS ($P_2O_5$ %) | $P_2O_5$ RECOVERED (%) |
|---|---|---|---|---|---|---|---|---|---|
| #1 | 10.1 | 0.85 | 0.85 | 29.7 | 10 | 30.4 | 70.3 | 0.6 | 90 |
| #2 | 19.0 | 1.5 | 1.5 | 67.3 | 18 | 27.6 | 32.7 | 0.5 | 99 |

As shown in Tables 1 and 2 above, the present invention provides several benefits. Since most of the fine silica has been rejected before entering the conditioner, the rougher concentrate contains very little fine silica. In these cases, it eliminates the need for a cationic flotation circuit. Acceptable phosphate grades of 31.4% and 33.3% $P_2O_5$ can be obtained simply by refloating the rougher concentrate 48 in water. The results of the refloat of the concentrates from Table 2 in water are shown in Table 3 below.

TABLE 3

| | Concentrate from Table 2 | | Final Concentrate | |
|---|---|---|---|---|
| Feed Source | Acid Insoluble (%) | $P_2O_5$ (%) | Acid Insoluble (%) | $P_2O_5$ % |
| 1 | 10 | 30.4 | 6.9 | 31.4 |
| 2 | 18 | 27.6 | 6.0 | 33.3 |

In the process of refloating, some of the coarse phosphate particles may sink together with the fine silica. However, because the difference in the particle sizes of the phosphate and silica, this phosphate can be easily recovered, for example, by sizing techniques known in the art. If the desired phosphate grade cannot be obtained simply by refloating in water, a silica depressant or pH modifier such as, for example, fluosilicic acid or sulfuric acid may be added to the water.

The absence of a cationic flotation circuit further improves phosphate recovery because no phosphate is lost through leaching of phosphate at low pH and no phosphate fine particles are lost through the cationic or cleaner flotation circuit. The present invention results in an overall phosphate recovery up to 10% higher than conventional flotation methods.

Example 2

A dilute aqueous dispersion of polymer, 68, 0.1 to 1 percent by weight, was added to an amine feed stream, 64. The polymer dispersion was prepared by using an in-line mixer, the neat polymer is measured in mls. A 5 percent dispersion of amine collector, 66, was added as shown in FIG. 1. The flotation results are tabulated in Table 4. Table 4 shows the effects of slime and the effect of polymer on amine consumption and phosphate concentrate grades. The slime content in the process water is measured in terms of turbidity. Water turbidity is measured as the distance, in inches, from the top, where a plate submersed in the water is barely visible. The phosphate concentrate grade is measured in terms of acid insoluble fractions.

As shown in Table 4, at a water turbidity of 3 (See Raw #1), a concentrate of 3.5 percent acid insoluble can be obtained using 6.2 gallons per minute of a 5 percent amine dispersion. The desired concentrate grade is 4 to 5.5 percent acid insoluble. When the slime content in the water increases (turbidity=1¼, See Raw #2), no silica flotation is observed, and foam overflows the launder. Reducing the feed rate from 150 ton per hour to 95 ton per hour and increasing the amine dosage to 11.14 gallons per minute improves the silica flotation. However, the concentrate still contains 7.3 percent acid insoluble (See Raw #3). Addition of 70 mls polymer in the form of 0.1 to 1 percent dispersion improves the grade of concentrate and eliminates the foam, i.e., a concentrate grade of 4 percent acid insoluble is obtained even though the water turbidity conditions are worse (See Raw #4). When the polymer is replaced by 0.6 gallons per minute of fuel oil No. 2, the foam is controllable but the concentrate acid insoluble is still slightly higher than the desired number (See Raw #5). Raw #9 and #6 show that when the water turbidity is 1, 7.6 gallons/minute amine dispersion plus 40 mls polymer produced a similar concentrate grade as that using 9.5 gallons/minute amine dispersion and 0.6 gallons/minute fuel oil. Raw #6 and #7 show that by replacing 0.6 gallons/minute fuel oil with 70 mls of polymer a better grade of concentrate is obtained. These results clearly show the unexpected advantages of this invention over the prior art processes. This invention minimizes the increase in collector usage without sacrificing the grade of phosphate concentrate, and without additional capital investment.

TABLE 4

| Raw # | Process Water Turbidity | Feed Rate (Ton/Hr.) | 5 percent Amine disp. (Gal./Min.) | Polymer (ml./Min.) | Concentrate Acid Insol. (percent) | Flotation Observation |
|---|---|---|---|---|---|---|
| 1 | 3 | 156+ | 6.2 | 0 | 3.5 | Not foamy |
| 2 | 1¼ | 150+ | 6.5 | 0 | >15 | Foamy, no silica flotation |
| 3 | ¾ | 95+ | 11.14 | 0 | 7.3 | Foamy |
| 4 | ⅓–½ | 95+ | 11.14 | 70 | 4.0 | Foam disappeared |
| 5 | ¾ | 95+ | 11.14 plus Fuel oil #2, 0.6 Gal/Min. | 0 | 6.0 | Foam is Controllable |
| 6 | 1 | 140+ | 9.5 plus Fuel oil #2, 0.6 Gal/Min. | 0 | 7.7 | Foam is Controllable |
| 7 | 1 | 140+ | 9.5 | 70 | 4.6 | No Foam |
| 8 | 1 | 100+ | 10 | 50 | 5.5 | Foam is Controllable |
| 9 | 1 | 150+ | 7.6 | 40 | 7.5 | Foam is Controllable |

3 = 3 inches visibility; the water contains very little slime and is considered normal.
1 = 1 inch visibility; the water contains a significant amount of slime.
The effect of slime begins to be significant when the water visibility is 2 inches in this particular beneficiation plant.

Example 3

In another phosphate beneficiation plant polymer, 68, was also added to the amine feed, 64, prior to collector, 66, addition. The flotation results of the amine circuit are shown in Table 5.

TABLE 5

| RAW # | Feed Rate (Ton/hr.) | 5 percent Amine disp. (Gal/min) | Polymer (ml/min) | Concentration Acid Insoluble (percent) | Flotation Observation |
|---|---|---|---|---|---|
| 1 | 80 | 3 | 0 | 7.8 | Foamy |
| 2 | 80 | 1.67 | 15 | 8.0 | Foam disappeared |
| 3 | 60 | 1.1 | 15 | 6.7 | No foam |
| 4 | 40 | 0.7 | 15 | 8.2 | No foam |
| 5 | 40 | 0.7 | 0 | 14.4 | Foamy |

As shown in Table 5, Raw #1 and #2 indicate that when polymer is used, the amine consumption is reduced from 3 gallons/minute to 1.67 gallons/minute, and the foam disappeared. Raw #5 and #4 indicate that when the same amount of amine is used, polymer improves the grade of the concentrate from acid insolubles of 14.4 percent to 8.2 percent. These results clearly show the benefits of using polymer according to this invention.

This invention is clearly new and useful. Moreover, it was not obvious to those of ordinary skill in this art at the time it was made.

The advantages of the present invention will thus be seen, and those made apparent from the foregoing description, are efficiently attained. Since certain changes may be made in the foregoing description without departing from the scope of the invention, it is intended that all matters contained in the foregoing description shall be interpreted as illustrative and not in a limiting sense.

Further, it is understood that alternative embodiments from that depicted in FIG. 1 are useful in the present invention. For example, the polymer can be added to the water entering the circuit or polymer can be added into the water together with the collector. Alternatively, the polymer and collector can be added simultaneously to the phosphate rock slurry stream prior to entry of the slurry stream into a flotation device.

Those skilled in the art recognize that other structures and features may be present in the beneficiation flow sheet of the present invention. For example, some beneficiation plants have distribution boxes at various positions in the flow sheet. Distribution boxes may be used for the addition of reagents. In addition, some beneficiation plants may have large tanks called sumps positioned at various points in the process. For example, a sump may be positioned prior the flotation devices in which the flotation feed is first deposited in the sump prior to distribution to the flotation device. The polymer can also be added to the sump. Additionally, sumps may be positioned prior to the conditioning step and after the acid scrub step.

It is also to be understood that the following claims are intended to cover all of the generic and specific features of the invention herein described and all statements of the scope of the invention which, as a matter of language, might be said to fall therebetween.

Now that the invention has been described,

What is claimed is:

1. A phosphate beneficiation process comprising the steps of:

adding to a dewatered rougher flotation feed slurry containing phosphates, silica and slime, an effective amount of polymer sufficient to cause flocculation of the slime;

adding to the dewatered rougher flotation feed slurry an effective amount of a collector sufficient to cause silica and the flocculated slime to become hydrophobic; and subjecting the dewatered rougher flotation feed slurry containing the hydrophobic silica and flocculated slime to flotation thereby causing the hydrophobic silica and slime to float, the processed rougher flotation feed slurry being upgraded for further phosphate beneficiation processing.

2. The process of claim 1, wherein the polymer is added to the rougher feed slurry prior to addition of the collector.

3. The process of claim 1, wherein the polymer and collector are added to the rougher feed slurry simultaneously.

4. The process of claim 1, further comprising a rougher flotation circuit wherein the flocculated slime from the rougher feed slurry is removed prior to a conditioning stage of the rougher flotation circuit;

adding an effective amount of a polymer to a cationic feed slurry wherein the polymer flocculates slime;

adding an effective amount of a cationic collector; and removing the flocculated slime by flotation.

5. The process of claim 4, wherein the polymer is added to the cationic feed slurry prior to addition of the cationic collector.

6. The process of claim 4, wherein the polymer and the cationic collector are added to the cationic feed slurry simultaneously.

7. The process of claim 4, wherein the cationic collector is selected from the group of long chain amines, amine salts, long chain quaternary ammonium salts, and mixtures thereof.

8. The process of claim 1, further comprising a rougher flotation circuit wherein the flocculated slime from the rougher feed slurry is removed prior to a conditioning stage of the rougher flotation circuit.

9. The process of claim 1, wherein the polymer is selected from the group consisting of natural polymers, semisynthetic polymers, synthetic polymers, and mixtures thereof.

10. The process of claim 9, wherein the natural polymer is selected from the group consisting of gum arabic, locust bean gum, guar gum, and mixtures thereof.

11. The process of claim 9, wherein the semisynthetic polymer is selected from the group consisting of carboxymethylcellulose, methylcellulose, hydroxyethylcellulose, guar gum derivatives, xanthan gum, and mixtures thereof.

12. The process of claim 9, wherein the synthetic polymer is selected from the group consisting of non-ionic polyacrylamide, polyethylene oxide, anionic hydrolyzed polyacrylamide, acrylamide/acrylate copolymer, cationic arylamide/diallyldimethylammonium chloride copolymer, acrylamide/amine copolymer, polyethylene amines, quaternized polyamines, polydiallyldimethylammonium chloride, polyethylene imine, polyalkalene polyamine, and mixtures thereof.

13. The process of claim 1, wherein the polymer is added to the phosphate beneficiation process in a water dispersion of from 0.001 to 2.5 percent by weight.

14. The process of claim 1, wherein the polymer is added to the phosphate beneficiation process in a water dispersion of from 0.05 to 1.0 percent by weight.

15. The process of claim 1, further comprising adding an effective amount of a polymer to a cationic feed slurry wherein the polymer flocculates slime;

adding an effective amount of a cationic collector; and removing the flocculated slime by flotation.

16. The process of claim 15, wherein the polymer is added to the cationic feed slurry prior to addition of the cationic collector.

17. The process of claim 15, wherein the polymer and the cationic collector are added to the cationic feed slurry simultaneously.

18. The process of claim 15, wherein the cationic collector is selected from the group of long chain amines, amine salts, long chain quaternary ammonium salts, and mixtures thereof.

19. A phosphate beneficiation process comprising the steps of:

adding to a cleaner phosphate ore feed slurry containing phosphates, silica and slime, an effective amount of polymer sufficient to cause flocculation of the slime;

adding an effective amount of a cationic collector sufficient to cause silica and the flocculated slime to become hydrophobic; and subjecting the cleaner phosphate ore feed slurry containing the hydrophobic silica and flocculated slime to flotation thereby causing the hydrophobic silica and slime to float, the cleaner feed slurry being discharged as phospate beneficiated material.

20. The process of claim 19, wherein the polymer is added to the cationic feed slurry prior to addition of the cationic collector.

21. The process of claim 19, wherein the polymer and the cationic collector are added to the cationic feed slurry simultaneously.

22. The process of claim 19, wherein the cationic collector is selected from the group of long chain amines, amine salts, long chain quaternary ammonium salts, and mixtures thereof.

23. The process of claim 19, wherein the polymer is selected from the group consisting of natural polymers, semisynthetic polymers, synthetic polymers, and mixtures thereof.

24. The process of claim 19, wherein the natural polymer is selected from the group consisting of gum arabic, locust bean gum, guar gum, and mixtures thereof.

25. The process of claim 19, wherein the semisynthetic polymer is selected from the group consisting of carboxymethylcellulose, methylcellulose, hydroxyethylcellulose, guar gum derivatives, xanthan gum, and mixtures thereof.

26. The process of claim 19, wherein the synthetic polymer is selected from the group consisting of non-ionic polyacrylamide, polyethylene oxide, anionic hydrolyzed polyacrylamide, acrylamide/acrylate copolymer, cationic arylamide/diallyldimethylammonium chloride copolymer, acrylamide/amine copolymer, polyethylene amines, quaternized polyamines, polydiallyldimethylammonium chloride, polyethylene imine, polyalkalene polyamine, and mixtures thereof.

27. The process of claim 19, wherein the polymer is added to the phosphate beneficiation process in a water dispersion of from 0.001 to 2.5 percent by weight.

28. The process of claim 19, wherein the polymer is added to the phosphate beneficiation process in a water dispersion of from 0.05 to 1.0 percent by weight.

* * * * *